US009755327B2

(12) United States Patent
Aoki et al.

(10) Patent No.: US 9,755,327 B2
(45) Date of Patent: Sep. 5, 2017

(54) CONNECTING STRUCTURE OF CRIMP TERMINAL AND ELECTRIC WIRE

(71) Applicant: Yazaki Corporation, Tokyo (JP)

(72) Inventors: Hiroshi Aoki, Shizuoka (JP); Kazuto Ohtaka, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/240,041

(22) Filed: Aug. 18, 2016

(65) Prior Publication Data

US 2016/0359245 A1 Dec. 8, 2016

Related U.S. Application Data

(63) Continuation of application No. PCT/JP2015/057636, filed on Mar. 16, 2015.

(30) Foreign Application Priority Data

Mar. 19, 2014 (JP) ..... 2014-057085

(51) Int. Cl.

| | |
|---|---|
| ***H01R 4/10*** | (2006.01) |
| ***H01R 4/62*** | (2006.01) |
| ***H01R 4/18*** | (2006.01) |
| ***H01R 13/52*** | (2006.01) |
| *H01R 13/11* | (2006.01) |

(52) U.S. Cl.

CPC ..... *H01R 4/62* (2013.01); *H01R 4/185* (2013.01); *H01R 13/5216* (2013.01); *H01R 13/113* (2013.01)

(58) Field of Classification Search

CPC ..... H01R 4/185; H01R 4/20; H01R 4/188; H01R 4/183; H01R 43/0484; F03G 7/065

USPC ..... 439/877, 878

See application file for complete search history.

(56) References Cited

U.S. PATENT DOCUMENTS

| | | | | |
|---|---|---|---|---|
| 5,519,170 | A * | 5/1996 | Nabeshima | H01R 13/5205 174/74 R |
| 2013/0040511 | A1* | 2/2013 | Takashima | H01R 4/024 439/882 |
| 2013/0095708 | A1* | 4/2013 | Mitose | H01R 4/184 439/878 |

FOREIGN PATENT DOCUMENTS

| | | |
|---|---|---|
| JP | 2012-69449 A | 4/2012 |
| WO | 2014/038400 A1 | 3/2014 |

OTHER PUBLICATIONS

International Search Report for PCT/JP2015/057636 dated May 19, 2015.

* cited by examiner

*Primary Examiner* — Hien Vu
(74) *Attorney, Agent, or Firm* — Sughrue Mion, PLLC

(57) ABSTRACT

A structure for connecting a crimp terminal and an electric wire includes: a crimp terminal that includes a conductor crimping portion and a coating crimping portion serially and includes an electric wire connector that is to be crimped to the electric wire; and a water stop sheet having an opening for bringing a conductor into contact with the conductor crimping portion, and laid between the electric wire connector and the electric wire. When a joint is swaged and crimped, the swaged and crimped joint has a second included angle θ2 between the bottom plate and a second line that is larger than a first included angle θ1 between the bottom plate and a first line in a cross section that is perpendicular to a bottom plate of the electric wire connector and that includes an electric wire axial line.

2 Claims, 5 Drawing Sheets

CONNECTING STRUCTURE OF CRIMP TERMINAL AND ELECTRIC WIRE

CROSS-REFERENCE TO RELATED APPLICATION

This application is a continuation application of International Application PCT/JP2015/057636, filed on Mar. 16, 2015, and designating the U.S., the entire contents of which are incorporated herein by reference.

BACKGROUND OF THE INVENTION

1. Field of the Invention

The present invention relates to a connecting structure of a crimp terminal and an electric wire.

2. Description of the Related Art

Reduction in the weight of a vehicle has a great influence on improvement of fuel consumption. Currently, reduction in carbon dioxide emission is required, and especially in an electric vehicle and a hybrid vehicle where the amount of wire harnesses used therein is larger than that in a gasoline-powered vehicle, it is preferable that an electric wire made of aluminum and an aluminum alloy of lightweight materials be used for a wire harness. However, in an aluminum-made electric wire made of aluminum or an aluminum alloy being crimped and connected to a crimp terminal made of copper or a copper alloy, when water is in a part where the electric wire and the crimp terminal contact each other, this water serves as an electrolyte between dissimilar metals. In dissimilar metals such as a copper-made terminal and an aluminum-made conductor, when an electric circuit is formed through an electrolyte, corrosion of a metal having a baser potential (for example, the aluminum conductor) is accelerated due to difference in corrosion potential of the dissimilar metals. In other words, galvanic corrosion occurs.

A crimp terminal capable of preventing electric corrosion while ensuring conductivity even when an electric wire conductor crimped to the barrel pieces is made of a metal dissimilar to the barrel pieces has been disclosed (see Japanese Patent Application Laid-open No. 2012-69449, FIG. 7, paragraph 0113, for example).

A female crimp terminal (crimp terminal) 501 illustrated in FIG. 6 includes barrel pieces 507 making up a crimping portion 505 for enclosing and crimping the exposed part of an aluminum core 503, on both sides of the crimping portion 505 in the width direction. The barrel pieces 507 are made of a conductive metal that is dissimilar to the aluminum core 503, e.g., copper. A surrounding surface 509 of the crimping portion 505 includes an insulating coating portion 511 (or a water stop sheet, for example). The insulating coating portion 511 extends longer than the length of the exposed part of the aluminum core 503. A covered electric wire 513 is crimped by the barrel pieces 507 to the female crimp terminal 501 in such a manner that the crimping portion 505 integrally covers a range from a position ahead of the tip of the aluminum core 503 to the covered portion of the covered electric wire 513 on the tip end. In this manner, the aluminum core 503 and the crimping portion 505 are sealed by the insulating coating portion 511 or the water stop sheet that is a water-proofing material laid between the aluminum core 503 and the crimping portion 505, and is proofed against entrance of water, and therefore is protected against galvanic corrosion.

Given the female crimp terminal 501, a press with a swaging die is used to ensure electrical and mechanical performance achieved by the crimping the electric wire.

With the female crimp terminal 501, when the aluminum core 503 is compressed with the swaging die, causing the aluminum core 503 to be crimped to and held by the crimping portion 505, the insulating coating portion 511 or the water stop sheet is also compressed. At this time, inside the crimp, the water stop sheet pushes a coating front end 515 (the cut surface of the coating of the stripped electric wire) in a direction extruding the coating out of the crimp. With the coating front end of the covered electric wire 513 pushed in a direction being extruded of the crimp, the crimping portion 505 can only be ensured of a smaller overlap width with respect to the crimped coating portion. Because the overlap width is reduced, the squeeze (the length in the extruded direction) of the water stop sheet positioned between the female crimp terminal 501 and the electric wire coating is also reduced. Furthermore, the overlap width required in ensuring sealing property may fall short, due to oscillations of the covered electric wire 513, or thermal expansion or contraction of the terminal/electric wire, for example.

SUMMARY OF THE INVENTION

The present invention is made in consideration of the issues mentioned above, and an object of the present invention is to provide a connecting structure of a crimp terminal and an electric wire capable of reducing the extrusion of the electric wire, and preventing reduction in sealing property.

In order to achieve the above mentioned object, a connecting structure of a crimp terminal and an electric wire according to one aspect of the present invention includes a crimp terminal that includes a conductor crimping portion and a coating crimping portion serially, the conductor crimping portion being configured to crimp a conductor of the electric wire, the coating crimping portion being configured to crimp the electric wire from an outer circumference of a coating, the crimp terminal including an electric wire connector configured to be crimped to the electric wire; and a water-proofing material having an opening for bringing the conductor into contact with the conductor crimping portion, having a size capable of surrounding the conductor that is to be crimped and the coating, and laid between the electric wire connector and the electric wire, wherein when a joint disposed between the conductor crimping portion and the coating crimping portion is swaged and crimped, the swaged and crimped joint has a second included angle that is larger than a first included angle in a cross section that is perpendicular to a bottom plate of the electric wire connector and that includes an electric wire axial line, the first included angle being an included angle between the bottom plate and a first line connecting a conductor crimping portion rear end point of the electric wire connector and a point corresponding to a position of a coating front end of the coating in an axial direction of the electric wire, and the second included angle being an included angle between the bottom plate and a second line connecting the conductor crimping portion rear end point and a coating crimping portion tip point of the electric wire connector.

According to another aspect of the present invention, in the connecting structure of the crimp terminal and the electric wire, it is preferable that the joint has a smaller interval between the conductor crimping portion rear end point and the coating crimping portion tip point in the direction of the electric wire axial line, the interval being smaller than an interval between the conductor crimping portion rear end point and the coating crimping portion tip point in a crimping direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiment

Figure 1:
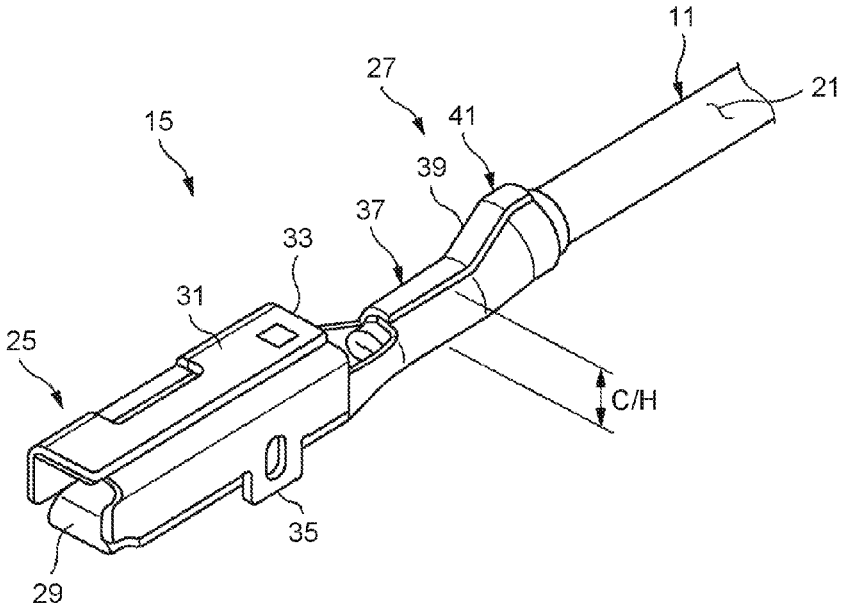
FIG. 1 is a perspective view of a crimp terminal used in a connecting structure of the crimp terminal and the electric wire according to an embodiment of the present invention.
Figure 2A:
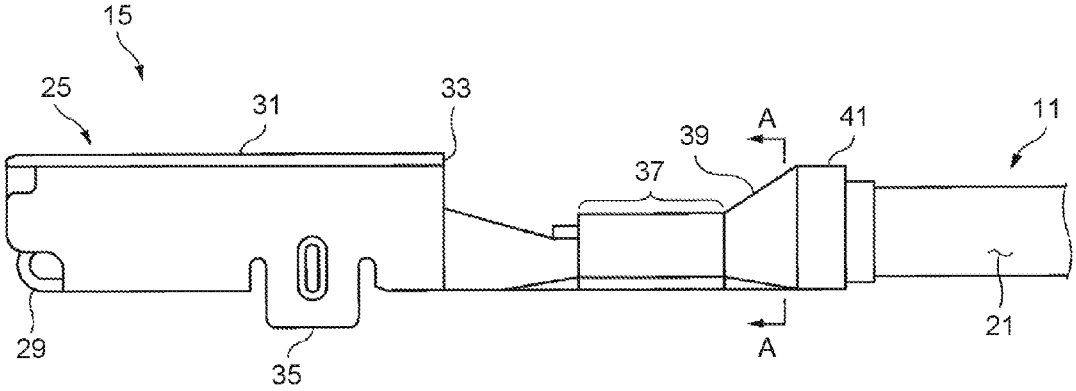
FIG. 2A is a side view of the crimp terminal illustrated in FIG. 1.
Figure 2B:
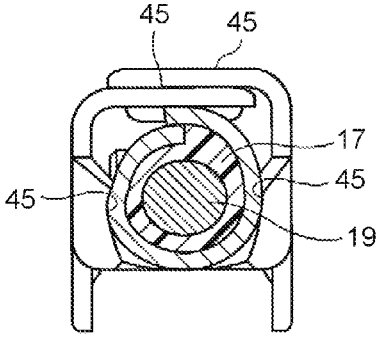
FIG. 2B is a cross-sectional view across A-A in FIG. 2A.

One embodiment of the present invention will be explained with reference to the accompanying drawings. As illustrated in FIGS. 1, 2A, and FIG. 2B, a connecting structure of a crimp terminal and an electric wire according to the embodiment includes an electric wire 11, a crimp terminal 15, and a water stop sheet 17 that is a water-proofing material.

The electric wire 11 includes a conductor 19 covered with an insulating coating 21. The conductor 19 is formed by twisting together a plurality of element wires. The conductor 19 may be a single wire. For example, aluminum and an aluminum alloy are used for the conductor 19. A synthetic resin is used for the coating 21. Examples of the synthetic resin include a resin formed by adding a flame retardant to a base such as polyvinyl chloride (PVC), polyolefin, and polyamide.

The crimp terminal 15 is formed by applying press working (punch working and folding working) to a sheet of metal plate made of a conductive metal (copper and a copper alloy). The crimp terminal 15 is punched while being connected to a carrier 23 into a chain shape. The crimp terminal 15 is installed on, for example, a connector housing (not illustrated) so as to be used. The crimp terminal 15 includes an electric contact portion 25 and an electric wire connector 27 serially from the tip end side. The electric contact portion 25 electrically contacts a counterpart terminal. The electric wire connector 27 is connected to the electric wire 11. A box 31 including a spring 29 is formed on the electric contact portion 25. The box 31 receives a tab-shaped conductor joint of a male terminal (not illustrated) serving as a counterpart terminal, and conductively connects the spring 29 to the male terminal. In other words, the crimp terminal 15 is a female terminal.

A lance locking portion 33 is formed on the box 31. When the crimp terminal 15 enters a terminal housing chamber of the connector housing, the lance locking portion 33 is locked to a lance (not illustrated) formed on the rear side of the connector housing. In this manner, the crimp terminal 15 is controlled not to slip backward off from the terminal housing chamber. The box 31 includes a spacer contact portion 35. When a spacer (not illustrated) is attached to the connector housing, a secondary locking portion formed on the spacer contacts the spacer contact portion 35.

On a front side, the electric wire connector 27 includes a conductor crimping portion 37 that is to be crimped to a conductor exposed portion of the electric wire 11 having the coating 21 of one terminal end stripped off and having conductor 19 exposed. On a rear side, the electric wire connector 27 includes a coating crimping portion 41 that is to be crimped onto the coating 21 around the terminal end of the electric wire 11, with a joint 39. The joint 39 connects the rear end of the conductor crimping portion 37 to the front end of the coating crimping portion 41. The conductor crimping portion 37 and the coating crimping portion 41 have sizes that are based on the diameters of the conductor 19 and of the coating 21, respectively.

Figure 3A:
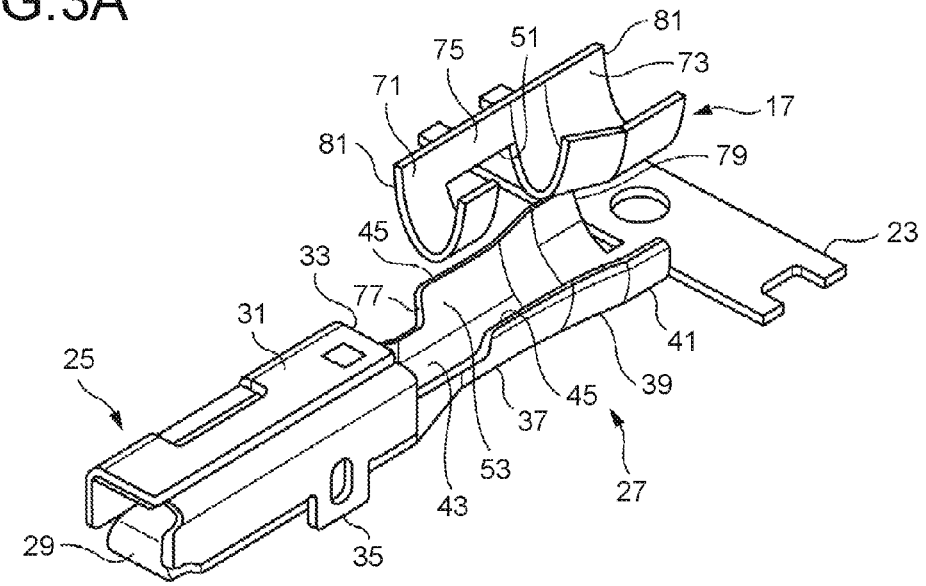
FIG. 3A is an exploded perspective view of the crimp terminal before a water-proofing material is assembled.
Figure 3B:
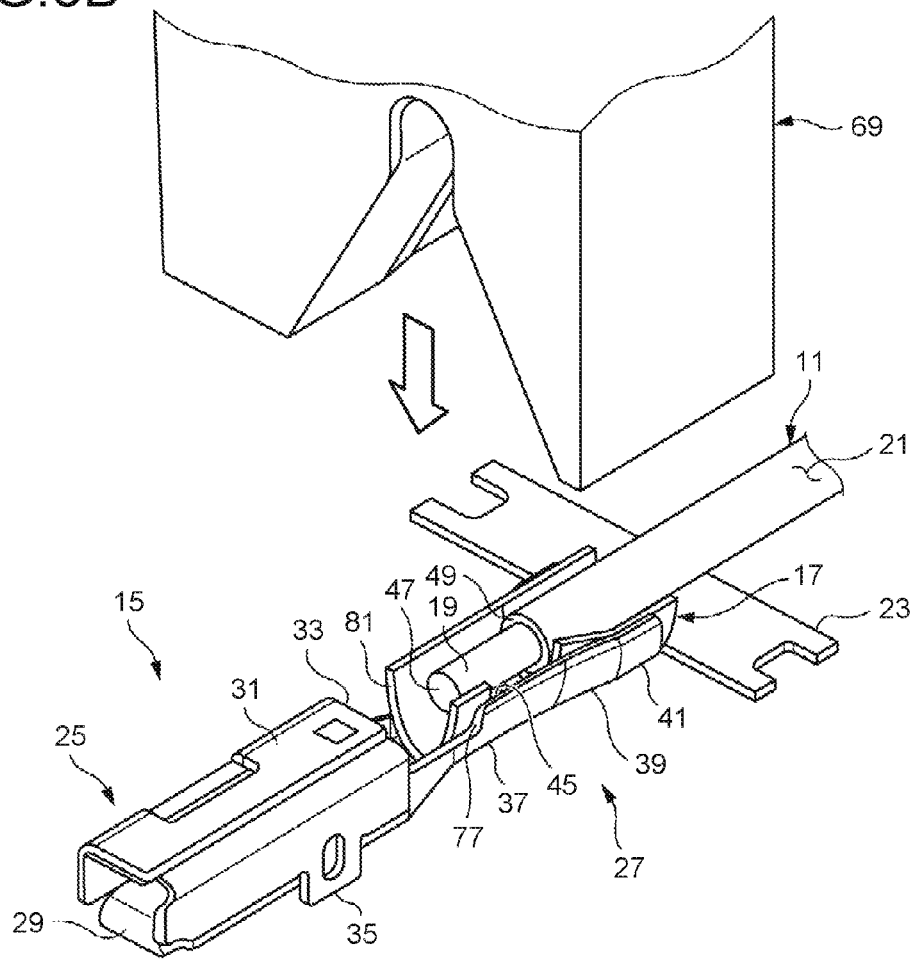
FIG. 3B is an exploded perspective view of the crimp terminal before being crimped to an electric wire.

As illustrated in FIGS. 3A and 3B, the conductor crimping portion 37 and the coating crimping portion 41 both share a bottom plate 43. The bottom plate 43 includes swaging pieces 45 provided as a pair on the right and the left sides, and provided standing upwardly from the right and the left edges, respectively. As illustrated in FIGS. 2A and 2B, the swaging pieces 45 are folded inside so as to wrap the conductor 19 and the coating 21 of the electric wire 11, and swage the conductor 19 and the coating 21 held in contact with the top surface of the bottom plate 43. The conductor crimping portion 37, the coating crimping portion 41, and the joint 39 have a continuous U-shaped cross section, being continuous from the front end of the conductor crimping portion 37 to the rear end of the coating crimping portion 41. The electric wire connector 27 has a length capable of integrally covering a range from a position ahead of the conductor front end 47 (see FIG. 3B) to a position behind a coating front end 49 (see FIG. 3B) in a configuration in which the electric wire connector 27 is crimped to the terminal end of the electric wire 11.

In this manner, the conductor crimping portion 37 for crimping the conductor 19 of the electric wire 11, and the coating crimping portion 41 for crimping the electric wire 11 from the outer circumference of the coating 21 are connected consecutively, and the crimp terminal 15 is crimped to and fixed to the electric wire 11.

The water stop sheet 17 is made of an insulating material such as a resin material or rubber having certain thickness and elasticity. The water stop sheet 17 has an opening 51 for bringing the conductor 19 into contact with the conductor crimping portion 37. The opening 51 according to the embodiment is formed by punching the water stop sheet 17 into a U-shape. The opening 51 may be, alternatively, a hole with its circumference closed. The water stop sheet 17 has such a size that the conductor 19 that is crimped and the coating 21 are surrounded thereby. The water stop sheet 17 is disposed on a water-proofing material facing surface 53 of the electric wire connector 27 so that the water stop sheet 17 is laid between the electric wire connector 27 and the electric wire 11. With the electric wire connector 27 swaged, the water stop sheet 17 encloses and seals the conductor 19 and the coating 21.

The water stop sheet 17 may be a double-sided adhesive sheet that is a sheet of the base material both sides of which have an adhesive layer. On each of the adhesive layers of the unused water stop sheet 17, a release sheet is provided via a release layer.

The electric wire connector 27 has a U-shaped cross section, and the electric wire 11 is disposed inside of the electric wire connector 27. The electric wire connector 27 is crimped in such a manner that a pair of edges on the aperture of the U-shaped structure overlaps each other (see FIG. 2B).

In the connecting structure of the crimp terminal 15 and the electric wire 11, in order to stabilize electrical performance in particular, it is preferable that the conductor 19 be compressed in such a manner that the conductor crimping portion 37 has a low post-crimp height C/H, as illustrated is FIG. 1. With this configuration, the water stop sheet 17 is more likely to be extruded.

In the connecting structure of the crimp terminal 15 and the electric wire 11 according to the embodiment, when the joint 39 has a larger internal volume, the extruding force in a direction extruding the coating front end 49 out of the crimp can be alleviated even when the post-crimp height C/H is low. With the electric wire 11 having the force extruding the coating front end 49 alleviated, reduction in the overlap width for the coating 21 is suppressed, and reduction in the sealing property is prevented. As a result, stable water-proofing performance can be achieved.

Figure 4:
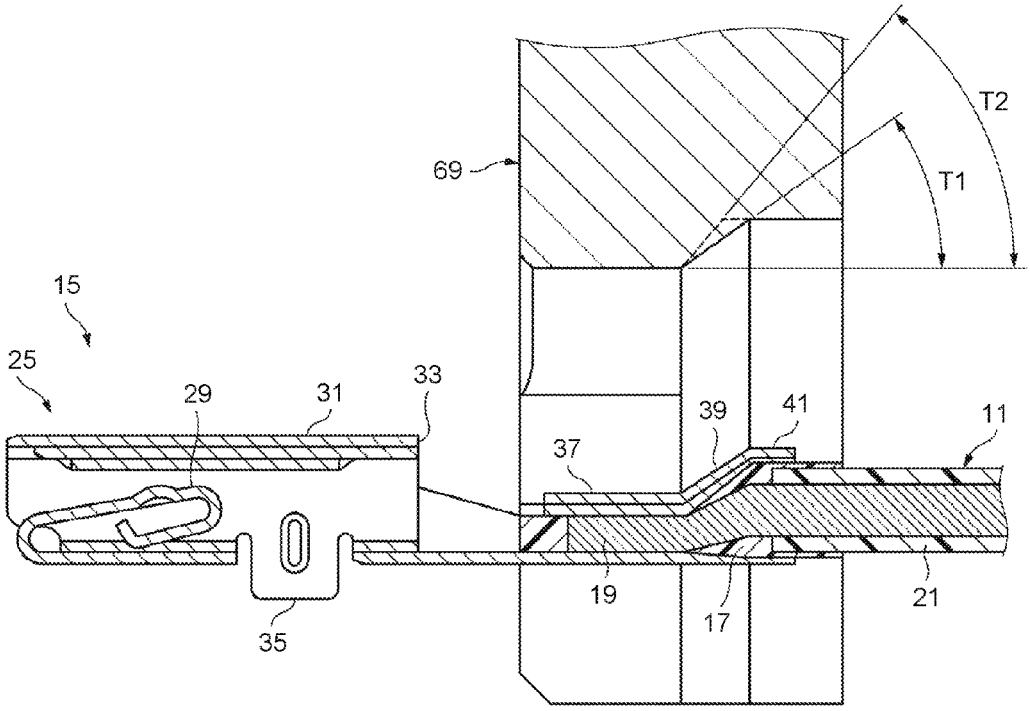
FIG. 4 is a cross-sectional view of a swaging die and the crimp terminal.
Figure 5A:
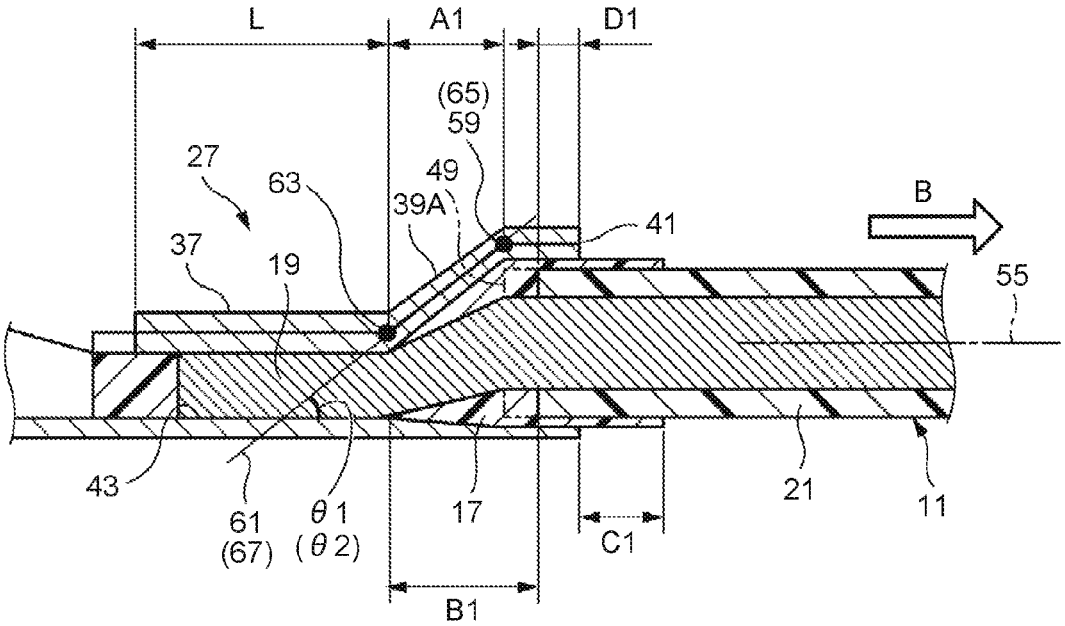
FIG. 5A is a view illustrating a function of a conventional connecting structure of a crimp terminal and an electric wire.
Figure 5B:
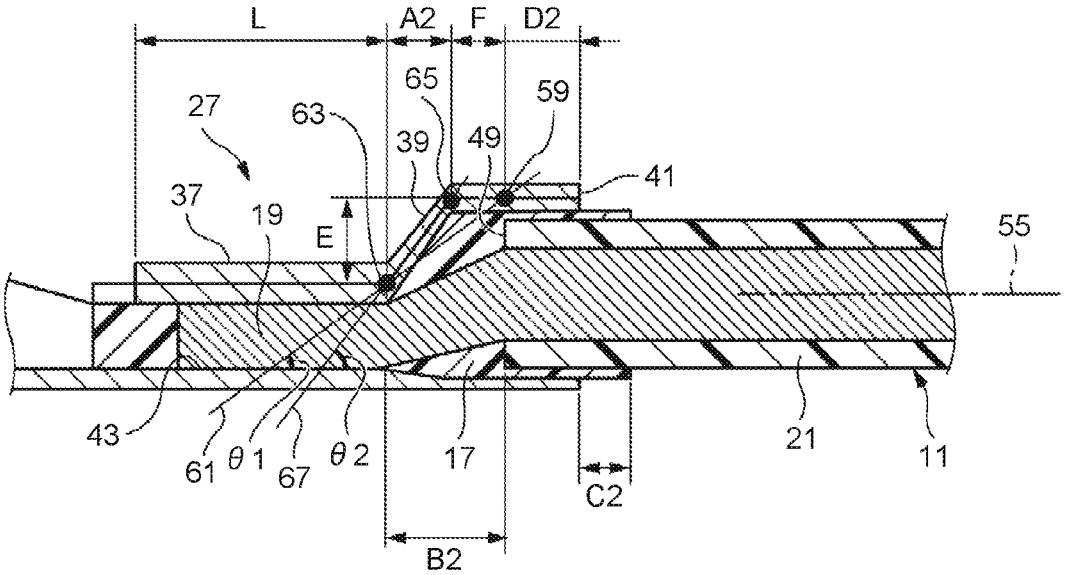
FIG. 5B is a view illustrating a function of the connecting structure of a crimp terminal and an electric wire according to the embodiment.
Figure 6:
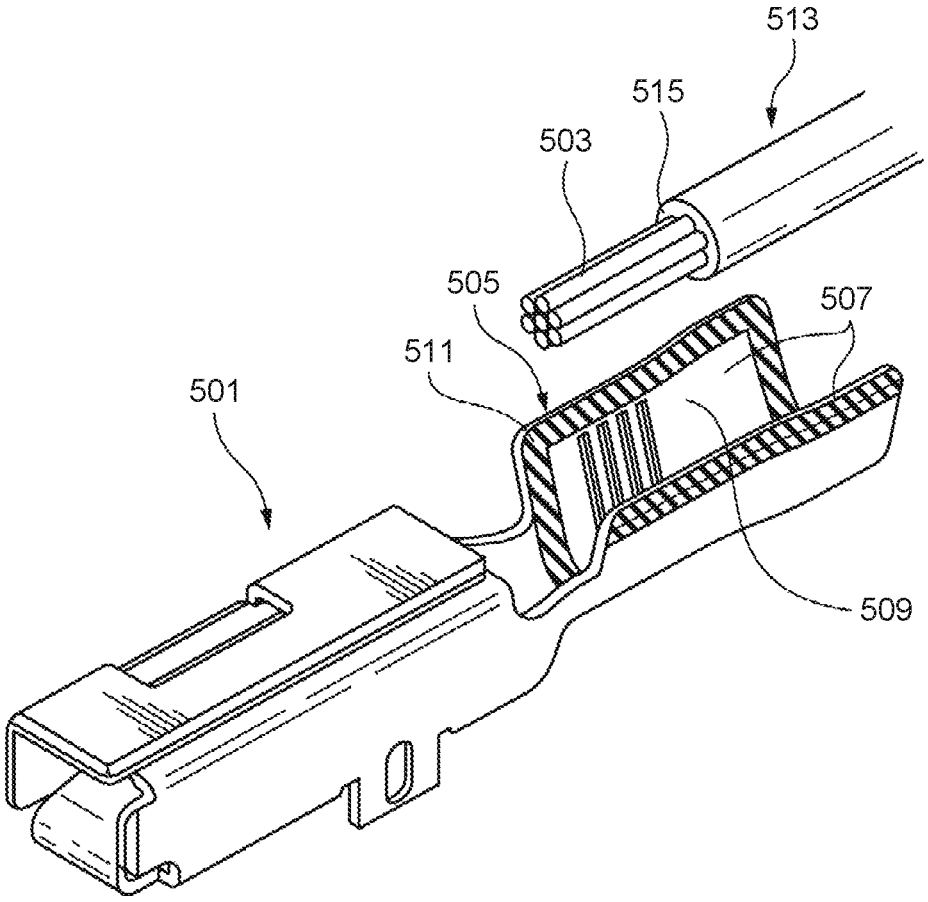
FIG. 6 is a perspective view of a conventional crimp terminal provided with a water-proofing material.

In the crimp terminal 15 according to the embodiment, once the joint 39, which is provided between the conductor crimping portion 37 and the coating crimping portion 41, is swaged and crimped, the joint 39 has a second included angle θ2 that is larger than a first included angle θ1 in a cross section that is perpendicular to the bottom plate 43 of the electric wire connector 27 and that includes an electric wire axial line 55, as illustrated in FIG. 5B. The first included angle θ1 herein is an included angle between the bottom plate 43 and a first line 61 connecting a conductor crimping portion rear end point 63 of the electric wire connector 27 and a point 59 corresponding to the position of the coating front end 49 of the coating 21 in the axial direction of the electric wire. The second included angle θ2 herein is an included angle between the bottom plate 43 and a second line 67 connecting the conductor crimping portion rear end point 63 and a coating crimping portion tip point 65 of the electric wire connector 27. The second included angle θ2 is achieved by setting the conventional taper angle T1 of a swaging die 69 illustrated in FIG. 4 to a taper angle T2 that is larger than the taper angle T1. After crimping, the water stop sheet 17 is filled in the joint 39. In the crimp terminal 15 according to the embodiment, the front end corresponds to an end on the side of the connection with a male terminal that is a counterpart terminal, and the rear end corresponds to an end on the side of the connection with the electric wire 11.

The joint 39 is formed in such a manner that the interval A2 illustrated in FIG. 5B between the conductor crimping portion rear end point 63 and the coating crimping portion tip point 65 in direction of the electric wire axial line 55 is smaller than the interval E between the conductor crimping portion rear end point 63 and the coating crimping portion tip point 65 in the crimping direction (vertical direction in FIG. 5B).

The steps at which the crimp terminal 15 and the electric wire 11 are connected will now be explained.

To begin with, as illustrated in FIG. 3A, the water stop sheet 17 having the opening 51 is placed at a position corresponding to the conductor exposed portion on the internal surface of the electric wire connector 27 having a U-shaped cross section in the crimp terminal 15. The water stop sheet 17 has a front-side sheet portion 71, on the front side of the opening 51, extending in the width direction of the electric wire connector 27, and a rear-side sheet portion 73, on the rear side of the opening 51, extending in the width direction of the electric wire connector 27. The water stop sheet 17 also has a side sheet portion 75 that connects the front-side sheet portion 71 and the rear-side sheet portion 73 along one side of the opening 51.

In addition, the water stop sheet 17 is formed in such a manner that, once the electric wire connector 27 is crimped to the terminal end of the electric wire 11, a water-proofing material front end 81 and a water-proofing material rear end 83 of the water stop sheet 17 protrude externally from a crimping portion front end 77 and a crimping portion rear end 79 of the electric wire connector 27, respectively. Specifically, the water stop sheet 17 has such a length that the water-proofing material front end 81 of the front-side sheet portion 71 comes at a position ahead of the crimping portion front end 77 of the conductor crimping portion 37, and the water-proofing material rear end 83 of the rear-side sheet portion 73 comes at a position behind the crimping portion rear end 79 of the coating crimping portion 41. The water stop sheet 17 is then adhered to the water-proofing material facing surface 53 of the electric wire connector 27 via an adhesive layer having been exposed by peeling off the release sheet on one side of the water stop sheet 17.

Once the water stop sheet 17 is placed on the water-proofing material facing surface 53 of the electric wire connector 27, the release sheet on the other side of the water stop sheet 17 is peeled off, so that the adhesive layer is exposed thereby, and the terminal end of the electric wire 11 having the coating 21 stripped (having the coating 21 removed by a certain length) is placed on the top surface of the bottom plate 43 of the electric wire connector 27. At this time, the conductor front end 47 of the conductor exposed portion is positioned behind the water-proofing material front end 81 of the water stop sheet 17. The coating front end 49 of the coating 21 is positioned ahead of the water-proofing material rear end 83 of the water stop sheet 17, and ahead of the crimping portion rear end 79 of the electric wire connector 27.

The electric wire connector 27 in this arrangement is then crimped to the terminal end of the electric wire 11 using the swaging die 69, as illustrated in FIG. 3B. In other words, the swaging pieces 45 on the right and the left side are folded inside in order and swaged so as to wrap the terminal end of the electric wire 11. The end of one of the swaging pieces 45 overlaps the end of the other swaging piece 45 as illustrated in FIG. 2B.

By swaging in this manner, the conductor crimping portion 37 of the crimp terminal 15 and the conductor 19 of the electric wire 11 are electrically connected via the opening 51 formed on the water stop sheet 17. The front side and the rear side of the connected part of the conductor crimping portion 37 and the conductor 19 are sealed by the water stop sheet 17. The water-proofing material front end 81 and the water-proofing material rear end 83 of the water stop sheet 17 protrude externally from the crimping portion front end 77 and the crimping portion rear end 79 of the electric wire connector 27, respectively, and the connecting structure according to the embodiment of the present invention is thus completed.

Functions achieved by the connecting structure of the crimp terminal 15 and the electric wire 11 having the configuration described above will now be explained.

In the connecting structure of the crimp terminal 15 and the electric wire 11 according to the embodiment, the water-proofing material is provided as the water stop sheet 17, as an example. The water-proofing material may also be insulating coating. The water stop sheet 17 is placed in the electric wire connector 27 so that the conductor 19 and the coating 21 are enveloped thereby. The electric wire connector 27 has a U-shape, as an example, and the electric wire 11 with the conductor 19 exposed is placed inside the U-shape, with the tip of the coating included.

The conductor 19 and the coating 21 disposed in the electric wire connector 27 are surrounded by the water stop sheet 17. More specifically, the size of the water stop sheet 17 is equal to or somewhat larger than the size of the electric wire connector 27. The water stop sheet 17 is laid in the electric wire connector 27, and the conductor 19 and the coating 21 are placed further internally.

The conductor crimping portion 37 and the coating crimping portion 41 of the electric wire connector 27 having the conductor 19 and the coating 21 disposed inside via the water stop sheet 17 are then crimped by respective crimp amounts. At this time, in the electric wire connector 27, a pair of edges on the aperture of the U-shaped structure (see FIG. 2B) overlaps each other.

The electric wire connector 27 itself is plastically deformed by swaging when the terminal is crimped, thereby plastically deforming the conductor 19 and the coating 21 of the electric wire 11 via the water stop sheet 17. The water stop sheet 17, having caused the conductor 19 and the coating 21 to deform as a result of swaging the electric wire connector 27, receives a reactive force of the conductor 19 and the coating 21. The water stop sheet 17 receiving the reactive force is compressed, and is moved across the extra space or the like inside the crimped electric wire connector 27.

At this time, a pressure in the direction causing the water stop sheet 17 to move and to protrude externally is applied from the inside of the electric wire connector 27. The joint 39 provided between the conductor crimping portion 37 and the coating crimping portion 31 has the second included angle θ2 that is larger than the first included angle θ1, the first included angle θ1 being an included angle between the bottom plate 43 and the first line 61 connecting the conductor crimping portion rear end point 63 of the electric wire connector 27 and the point 59 corresponding to the position of the coating front end 49 of the coating 21 in the axial direction of the electric wire, and the second included angle θ2 being an included angle between the bottom plate 43 and the second line connecting the conductor crimping portion rear end point 63 and the coating crimping portion tip point 65 of the electric wire connector 27, as illustrated in FIG. 5B. The joint 39 having such a configuration therefore has an internal volume larger than a joint 39A of the conventional structure (see FIG. 5A) in which the second included angle θ2 is substantially the same as the first included angle θ1. As a result, the extruding force in a direction extruding the coating front end 49 out of the crimp is alleviated as compared with that in the conventional structure illustrated in FIG. 5A. In the electric wire 11 with a smaller extruding force applied to the coating front end 49, reduction in the overlap width for the coating 21 is suppressed, and reduction in the sealing property is prevented.

Explained now as an example are two crimp terminals in which the length of the conductor exposed portions have the same length and the conductor crimp lengths L illustrated in FIGS. 5A and 5B are the same.

With the crimp terminal having a joint 39A with the second included angle θ2 that is substantially equal to the first included angle θ1, as illustrated in FIG. 5A, when the crimp terminal is crimped to the electric wire, the water stop sheet 17 having been adhered to the electric wire connector 27 is compressed. The water stop sheet 17 positioned between the conductor crimping portion 37 and the coating crimping portion 41 then pushes the coating front end 49 (the cut surface of the coating 21 of the stripped electric wire) in the direction of arrow B. As a result, the overlap width D1 between the electric wire connector 27 and the coating 21 is reduced. In such a case, because the overlap width D1 is reduced, the squeeze of the water stop sheet 17 positioned between the crimp terminal and the coating 21 (length in the extruded direction) may be reduced, and the size of overlap width D1 required in ensuring sealing property may come short due to oscillations of the electric wire 11, or thermal expansion or contraction of the terminal and the electric wire, for example.

By contrast, for the crimp terminal 15 having the joint 39 with the second included angle θ2 larger than the first included angle θ1, as illustrated in FIG. 5B, the swaging die 69 (see FIG. 4) has a smaller size for the part corresponding to the interval A1 between the conductor crimping portion rear end point 63 and the coating crimping portion tip point 65 of the joint 39A of the conventional electric wire connector 27 in the direction of the electric wire axial line (the taper angle is increased from T1 to T2). The resultant interval A2 between the conductor crimping portion rear end point 63 and the coating crimping portion tip point 65 of the joint 39 in the direction of the electric wire axial line is smaller than the interval A1 in the joint 39A. An interval F is thus provided, in the direction of the electric wire axial line, between the coating crimping portion tip point 65 and the point 59 corresponding to the position of the coating front end 49 in the joint 39, in the axial direction of the electric wire. Therefore, the internal volume of the joint 39 is increased as compared with that of the joint 39A. With the same water stop sheet 17, the sheet volume in a sheet housing space within a section B2 illustrated in FIG. 5B is increased as compared with that in a sheet housing space within a section B1 illustrated in FIG. 5A, and therefore, the extruding force in a direction extruding the coating front end 49 out of the crimp is alleviated as compared with that in the conventional structure. Because the extruding force imposed on the coating front end 49 is alleviated, reduction in the overlap width is suppressed, from the overlap width D1 to the overlap width D2. With the overlap width ensured, the sheet protruding amount C1 is reduced to the sheet protruding amount C2 which is smaller than the sheet protruding amount C1.

The deformed water stop sheet 17 is disposed highly densely, with no space inside the electric wire connector 27 that is swaged when the terminal is crimped. As a result, water does not easily get inside of the electric wire connector 27 from the external. In this manner, no electrolyte is supplied between the dissimilar metals. Therefore, galvanic corrosion of the electric wire 11 made of aluminum or aluminum alloy that is crimped to the conductor crimping portion 37 made of copper or copper alloy, for example, is suppressed.

Furthermore, in the connecting structure of the crimp terminal 15 and the electric wire 11 according to the embodiment, the internal volume of the joint 39 can be adjusted by setting the taper angle T2 of the swaging die 69 illustrated in FIG. 4 correspondingly to the amount (volume) of the water stop sheet 17 contained between the conductor crimping portion 37 and the coating crimping portion 41, at the time of crimping the terminal, and by forming the joint 39 with the swaging die 69. In this manner, even when the same crimp terminal is to be used among electric wires with different sizes, by setting the taper angle T2 of the swaging die 69 in a manner suitable for each of the electric wire size, water-proofing performance can be ensured easily, even when the same terminal is used.

Furthermore, in the connecting structure of the crimp terminal 15 and the electric wire 11 according to the embodiment, the joint 39 has the smaller interval A2 between the conductor crimping portion rear end point 63 and the coating crimping portion tip point 65 in the direction of the electric wire axial line, being smaller than the interval E between the conductor crimping portion rear end point 63 and the coating crimping portion tip point 65 in the crimping direction. Therefore, the length of the joint 39 in the direction of the electric wire axial line is reduced, while ensuring a larger internal volume of the joint 39. Hence, the total length of the electric wire connector 27 is prevented from being extended.

Therefore, the connecting structure of the crimp terminal 15 and the electric wire 11 according to the embodiment can reduce the extrusion of the electric wire, and can prevent reduction in the sealing property.

The present invention is not limited to the embodiment described above, and can be modified or improved, for example, as appropriate. In addition, the material, the shape, the size, the number, the location, and the like of each component in the embodiment described above are optional and not limiting as long as the present invention can be embodied.

The characteristics of the connecting structure of a crimp terminal to an electric wire according to the embodiment of the present invention described above will now be briefly summarized and listed below as [1] and [2].

[1] The connecting structure of the crimp terminal 15 and the electric wire 11 including:

the crimp terminal 15 that includes the conductor crimping portion 37 and the coating crimping portion 41 serially, the conductor crimping portion 37 being configured to crimp the conductor 19 of the electric wire 11, the coating crimping portion 41 being configured to crimp the electric wire 11 from the outer circumference of the coating 21, the crimp terminal 15 including the electric wire connector 27 configured to be crimped to the electric wire 11; and the water-proofing material (water-proofing sheet) 17 having the opening 51 for bringing the conductor 19 into contact with the conductor crimping portion 37, having a size capable of surrounding the conductor 19 that is to be crimped and the coating 21, and laid between the electric wire connector 27 and the electric wire 11, wherein when the joint 39 disposed between the conductor crimping portion 37 and the coating crimping portion 41 is swaged and crimped, the swaged and crimped joint 39 has the second included angle θ2 that is larger than the first included angle θ1 in a cross section that is perpendicular to the bottom plate 43 of the electric wire connector 27 and that includes the electric wire axial line 55, the first included angle θ1 being an included angle between the bottom plate 43 and the first line 61 connecting the conductor crimping portion rear end point 63 of the electric wire connector 27 and the point 59 corresponding to the position of the coating front end 49 of the coating 21 in the axial direction of the electric wire, and the second included angle θ2 being an included angle between the bottom plate 43 and the second line 67 connecting the conductor crimping portion rear end point 63 and the coating crimping portion tip point 65 of the electric wire connector 27.

As described above, with the connecting structure of a crimp terminal and an electric wire according to the embodiment, the electric wire connector itself is plastically deformed by swaging when the terminal is crimped, thereby plastically deforming the conductor and the coating of the electric wire via the water-proofing material such as a water stop sheet. The water-proofing material causing the conductor and the coating to deform, as the electric wire connector is swaged, receives a reactive force of the conductor and the coating. The water-proofing material receiving the reactive force is compressed, and is moved across the extra space or the like in the swaged electric wire connector.

At this time, a pressure in the direction causing the water-proofing material to move and to protrude externally is applied from the inside of the electric wire connector. The joint provided between the conductor crimping portion and the coating crimping portion has the second included angle that is larger than the first included angle, the first included angle being an included angle between the bottom plate and the first line connecting the conductor crimping portion rear end point of the electric wire connector and the point corresponding to the position of the coating front end of the coating in the axial direction of the electric wire, and the second included angle being an included angle between the bottom plate and the second line connecting the conductor crimping portion rear end point and the coating crimping portion tip point of the electric wire connector. The joint having such a configuration therefore has an internal volume larger than the joint of the conventional structure in which the second included angle is substantially the same as the first included angle. As a result, the extruding force in a direction extruding the coating front end out of the crimp is alleviated as compared with that in the conventional structure. In the electric wire having a smaller extruding force applied to the coating front end, reduction in the overlap width for the coating is suppressed, and reduction in the sealing property is prevented.

The deformed water-proofing material is highly densely disposed, with no space inside the electric wire connector that is swaged when the terminal is crimped. As a result, water does not easily get inside of the electric wire connector from the external. In this manner, no electrolyte is supplied between the dissimilar metals. Therefore, galvanic corrosion of the electric wire made of aluminum or aluminum alloy that is crimped to the conductor crimping portion made of copper or copper alloy, for example, is suppressed.

Furthermore, the internal volume of the joint can be adjusted by setting the taper angle of the swaging die correspondingly to the amount (volume) of the water-proofing material housed between the conductor crimping portion and the coating crimping portion when the terminal is crimped to the electric wire, and by forming the joint with the swaging die. In this manner, even when the same crimp terminal is to be used among electric wires having different sizes, by setting the taper angle of the swaging die in a manner suitable for each of the electric wire sizes, water-proofing performance can be ensured easily when the common terminal is used.

[2] The connecting structure of the crimp terminal 15 and the electric wire 11 according to [1] above, wherein the joint 39 has a smaller interval A2 between the conductor crimping portion rear end point 63 and the coating crimping portion tip point 65 in the direction of the electric wire axial line, the interval A2 being smaller than the interval E between the conductor crimping portion rear end point 63 and the coating crimping portion tip point 65 in the crimping direction.

Furthermore, with the connecting structure of a crimp terminal and an electric wire according to the embodiment, the length of the electric wire in the axial line direction is reduced, while ensuring a larger internal volume of the joint. Hence, the total length of the electric wire connector is prevented from being extended.

The connecting structure of a crimp terminal and an electric wire according to the present invention can reduce the extrusion of the electric wire, and prevent reduction in the sealing property.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connecting structure of a crimp terminal and an electric wire, the connecting structure comprising:

a crimp terminal that includes a conductor crimping portion and a coating crimping portion serially, the conductor crimping portion being configured to crimp a conductor of the electric wire, the coating crimping portion being configured to crimp the electric wire from an outer circumference of a coating, the crimp terminal including an electric wire connector configured to be crimped to the electric wire; and a water-proofing material having an opening for bringing the conductor into contact with the conductor crimping portion, having a size capable of surrounding the conductor that is to be crimped and the coating, and laid between the electric wire connector and the electric wire, wherein when a joint disposed between the conductor crimping portion and the coating crimping portion is swaged and crimped, the swaged and crimped joint has a second included angle that is larger than a first included angle in a cross section that is perpendicular to a bottom plate of the electric wire connector and that includes an electric wire axial line, the first included angle being an included angle between the bottom plate and a first line connecting a conductor crimping portion rear end point of the electric wire connector and a point corresponding to a position of a coating front end of the coating in an axial direction of the electric wire, and the second included angle being an included angle between the bottom plate and a second line connecting the conductor crimping portion rear end point and a coating crimping portion tip point of the electric wire connector.

2. The connecting structure of the crimp terminal and the electric wire according to claim 1, wherein the joint has a smaller interval between the conductor crimping portion rear end point and the coating crimping portion tip point in the direction of the electric wire axial line, the interval being smaller than an interval between the conductor crimping portion rear end point and the coating crimping portion tip point in a crimping direction.

* * * * *